US008418295B2

(12) United States Patent
Clark

(10) Patent No.: US 8,418,295 B2
(45) Date of Patent: Apr. 16, 2013

(54) NURSING PILLOW WITH BOLSTER AROUND THE CIRCUMFERENCE THEREOF AND PRIVACY SHROUD

(75) Inventor: Sandra Clark, Jamul, CA (US)

(73) Assignee: Double Blessings, Inc., Jamul, CA (US)

( * ) Notice: Subject to any disclaimer, the term of this patent is extended or adjusted under 35 U.S.C. 154(b) by 0 days.

(21) Appl. No.: 12/953,357

(22) Filed: Nov. 23, 2010

(65) Prior Publication Data

US 2011/0119833 A1 May 26, 2011

Related U.S. Application Data

(60) Provisional application No. 61/281,973, filed on Nov. 24, 2009.

(51) Int. Cl.
*A47G 9/10* (2006.01)

(52) U.S. Cl.
USPC ..... 5/655; 5/632; 5/646; 5/633; 5/652

(58) Field of Classification Search ..... 5/655, 632, 5/646, 633, 652
See application file for complete search history.

(56) References Cited

U.S. PATENT DOCUMENTS 4,731,890 A 3/1988 Roberts
D318,202 S 7/1991 Weber
D318,969 S 8/1991 Byrn
5,092,005 A 3/1992 Byrn
5,109,557 A 5/1992 Koy et al.
5,154,649 A 10/1992 Pender
5,261,134 A 11/1993 Matthews
5,371,909 A 12/1994 McCarty
5,519,906 A 5/1996 Fanto-Chan
5,551,109 A 9/1996 Tingley et al.
5,581,833 A 12/1996 Zenoff
5,661,861 A 9/1997 Matthews
5,790,999 A 8/1998 Clark
6,061,854 A 5/2000 Crowley
6,189,169 B1 2/2001 Marcotte
6,233,767 B1 5/2001 Horowitz
D443,461 S 6/2001 Hall et al.
D444,981 S 7/2001 Hall et al.
6,484,337 B1 11/2002 Moe et al.
6,532,612 B2 3/2003 Matthews Brown
6,564,408 B2 5/2003 VanVuuren
6,658,681 B2 * 12/2003 Britto et al. ..... 5/655
6,671,908 B2 1/2004 Brown et al.
6,685,024 B1 2/2004 Matthews
6,711,770 B1 3/2004 Owens et al.
6,842,925 B1 1/2005 Owens et al.
D503,062 S 3/2005 Nash
7,010,821 B1 3/2006 Leach
7,127,760 B2 10/2006 Bartley et al.
7,331,073 B2 2/2008 Littlehorn et al.
D567,562 S 4/2008 Nash
D571,596 S * 6/2008 Alvistur et al. ..... D6/601
7,430,774 B2 10/2008 Littlehorn et al.
(Continued)

*Primary Examiner* — William Kelleher
(74) *Attorney, Agent, or Firm* — Knobbe, Martens, Olson & Bear, LLP

(57) ABSTRACT

A nursing pillow system for providing support to one or more children during breastfeeding or bottle feeding. The system preferably includes a cover-up which provides privacy during feeding. The cover-up may be removably attached and stored in an integrated pocket in the nursing pillow system. Other features, such as a bolster, belt, back pillow, elastic bands, and pockets may be included to increase the comfort and utility of the system.

11 Claims, 8 Drawing Sheets

U.S. PATENT DOCUMENTS

| | | | | |
|---|---|---|---|---|
| 7,454,808 | B2 * | 11/2008 | Parrilla | 5/655 |
| 7,464,423 | B2 | 12/2008 | Goodwin et al. | |
| 7,513,001 | B1 | 4/2009 | Leach | |
| 7,587,773 | B2 | 9/2009 | Littlehorn et al. | |
| 2002/0023301 | A1 * | 2/2002 | Vuuren | 5/655 |
| 2006/0162080 | A1 * | 7/2006 | Littlehorn et al. | 5/652 |
| 2006/0265809 | A1 * | 11/2006 | Wagner | 5/655 |
| 2008/0313813 | A1 * | 12/2008 | Adiri et al. | 5/655 |
| 2009/0133192 | A1 * | 5/2009 | Hassell et al. | 5/639 |
| 2009/0199343 | A1 * | 8/2009 | Collins | 5/655 |
| 2011/0023236 | A1 * | 2/2011 | Sanders et al. | 5/655 |

* cited by examiner

NURSING PILLOW WITH BOLSTER AROUND THE CIRCUMFERENCE THEREOF AND PRIVACY SHROUD

CROSS-REFERENCE TO RELATED APPLICATIONS

This patent application claims priority under 35 U.S.C. §119(e) to U.S. Provisional Patent Application Ser. No. 61/281,973 filed Nov. 24, 2009. The disclosure of U.S. Provisional Patent Application Ser. No. 61/281,973 is hereby incorporated by reference in its entirety.

BACKGROUND OF THE INVENTION

Breast-feeding a baby can be an important element in the proper development of a child. Nursing is related to many aspects of a child's development including the proper development of muscles of the child's mouth and tongue which can decrease the likelihood of speech problems, a stronger bond between a mother and child, and balanced eye development resulting from a child's ability to look at his mother alternatingly with only one eye when the child is nursed on each side.

In spite of these advantages, nursing can be a complicated process involving supporting the weight of a baby's body and head, and holding the body and head in a position such that the baby can properly latch on to the breast for feeding. Additionally, these feeding sessions can extend beyond an hour in length, forcing the mother to properly support the baby's body and head for long periods of time. This exertion can be further complicated by the need to feed multiple babies or late night feedings. These problems have been frequently addressed by a variety of nursing aids ranging from slings, carriers, and arm supports to pillows. While these have proven beneficial to mothers, they have only partially addressed issues of baby and mother comfort, ease of use, and privacy.

SUMMARY OF THE INVENTION

According to one aspect of the invention, a nursing pillow system is provided, comprising: a nursing pillow comprising a pocket, a cover-up attached to the nursing pillow, wherein the cover-up is configured to cover at least a portion of a user and a baby when in use, and wherein the pocket is configured to store the cover-up when not in use.

In another embodiment, the cover-up is removably attached to the nursing pillow. In another embodiment, the cover-up comprises a loop or hole which is configured to be placed over the user's head.

In another embodiment, the nursing pillow defines an outer perimeter opposite the user, wherein the cover-up is attached to said outer perimeter of said nursing pillow. In another embodiment, the nursing pillow system further comprises a bolster extending along said outer perimeter of said nursing pillow.

In another embodiment, the cover-up comprises a sheet of material having holes. In another embodiment, the material having holes comprises a mesh fabric.

In another embodiment, the cover-up is attached to the nursing pillow inside said pocket.

According to another aspect of the invention, a nursing pillow system is provided, comprising: a nursing pillow comprising a generally U-shape form defining a thickness, inner perimeter, outer perimeter, and two arms, wherein the thickness decreases from said outer perimeter to said inner perimeter, a pillow cover attached to said nursing pillow, a belt attached to said pillow cover, a bolster extending at least halfway down each arm along said outer perimeter, wherein the bolster is attached to said pillow cover.

In another embodiment, the nursing pillow system further comprises a back pillow.

In another embodiment, the bolster extends substantially all the way down each arm along said outer perimeter.

In another embodiment, the bolster is formed integrally with the nursing pillow.

In another embodiment, the nursing pillow system further comprises an elastic band defining a length attached to the pillow cover.

In another embodiment, the nursing pillow system further comprises at least one pocket attached to the pillow cover.

In another embodiment, the nursing pillow system further comprises a cover-up, wherein the cover-up is removably attached to the pillow cover.

In another embodiment, the nursing pillow system further comprises a pocket, wherein the pocket is configured to store the cover-up.

In another embodiment, the nursing pillow further defines an overall length and overall depth, and the arms define a width, wherein: the overall length is approximately 21 inches, the overall depth is approximately 9 inches, the thickness at the inner perimeter is approximately 3.5 inches, the thickness at the outer perimeter is approximately 5.5 inches, and the width of the arms is approximately 5 inches.

In another embodiment, the nursing pillow further defines an overall length and overall depth, and the arms define a width, wherein: the overall length is approximately 24 inches, the overall depth is approximately 21 inches, the thickness at the inner perimeter is approximately 4 inches, the thickness at the outer perimeter is approximately 6 inches, and the width of the arms is approximately 7 inches.

According to another aspect of the invention, a nursing pillow system is provided, comprising: a nursing pillow comprising a generally U-shape form defining a thickness, inner perimeter, outer perimeter, and two arms, wherein the thickness decreases from said outer perimeter to said inner perimeter, a pillow cover attached to said nursing pillow, a belt attached to said pillow cover, a back pillow attached to said belt, a bolster extending at least halfway down each arm along said outer perimeter, wherein the bolster is attached to said pillow cover, a cover-up attached to said pillow cover, wherein the cover-up is comprised of mesh fabric, and a pocket located along the bottom of the bolster, wherein the pocket is configured to store the cover-up.

In another embodiment, the nursing pillow is configured to removably receive the back pillow along the inner perimeter of the nursing pillow.

BRIEF DESCRIPTION OF THE DRAWINGS

Embodiments of the invention are described in detail below with reference to the attached figures, wherein.

The figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 1:
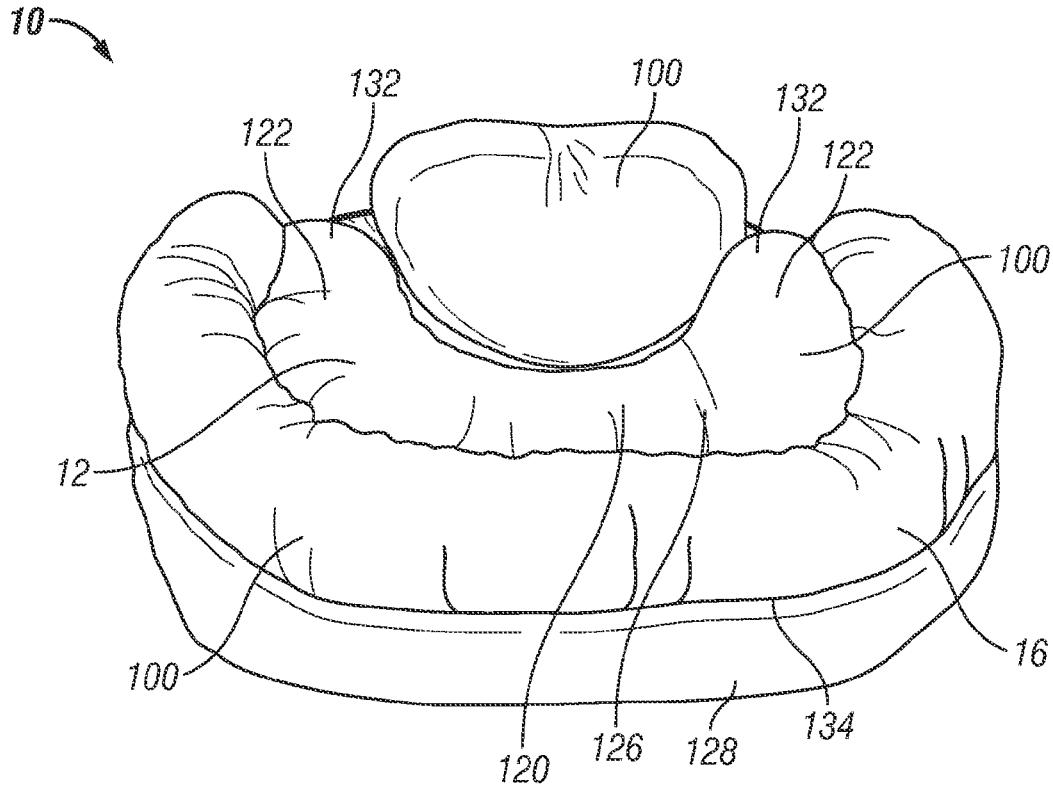
FIG. 1 is a front perspective view of a nursing pillow system having a nursing pillow, bolster, and back pillow according to a preferred embodiment of the invention.

The following description and examples illustrate preferred embodiments of the present invention in detail. Those of skill in the art will recognize that there are numerous variations and modifications of this invention that are encompassed by its scope. Accordingly, the description of a preferred embodiment should not be deemed to limit the scope of the present invention Multiple embodiments of a nursing pillow system 10 are described in FIGS. 1-13. These embodiments address multiple aspects of the problems facing nursing mothers. As depicted in FIG. 1, in order to enable the mother to more easily nurse her child, the nursing pillow 12 in the nursing pillow system 10 generally has a horseshoe shape, having a middle portion 120 and two arms 122. This shape enables the mother to position herself such that the when her torso is located inside the horseshoe shape facing the middle section 120, the arms 122 of the nursing pillow 12 wrap around the sides of her body. By wrapping around the mother's body, the nursing pillow 12 enables the mother to lay her child in a wide variety of positions relative to her body. This allows the mother to select the most comfortable position for herself and for the child. Additionally, the area 124 (see FIG. 3) within which the mother positions her body is advantageously designed such that the nursing pillow 12 sits in relative proximity to the mother's body. This prevents the child from slipping into the gap between the mother and the nursing pillow 12 and thus eases nursing.

Some embodiments of the nursing pillow system 10 may have one or more removable covers 100. This includes removable covers 100 on parts of the nursing pillow system 10 such as the nursing pillow 12, back pillow 14, and bolster 16. The removable cover 100 of the bolster 16 and the removable cover 100 of the nursing-pillow 12 may be permanently or removably attached to each other. Additionally, the removable cover 100 of the nursing pillow 12 may serve as the platform to which other features such as the bolster 16, belt 18, cover-up 20, elastic band 102, and pocket 104 may be attached. Advantageously these covers 100 enable the maintenance of cleanliness as they can be easily removed, washed, and dried. These removable covers 100 also provide the advantage of allowing an individual to customize the appearance by using a different cover.

In some embodiments, the nursing pillow 12 is also provided with a broad top surface 126 which supports the weight of the infant. This top surface 126 may be sufficiently wide to allow the infant to rest his body on the nursing pillow 12, thus providing complete support for the weight of the infant. Additionally, this top surface 126 is spaced sufficiently above the bottom surface (not shown) of the nursing pillow 12 to enable the mother to generally set the nursing pillow 12 on her lap and have the top surface 126 of the nursing pillow 12 at the proper height relative to her breasts to enable breast-feeding without further adjustment of the nursing pillow 12 or support of the child.

Figure 2:
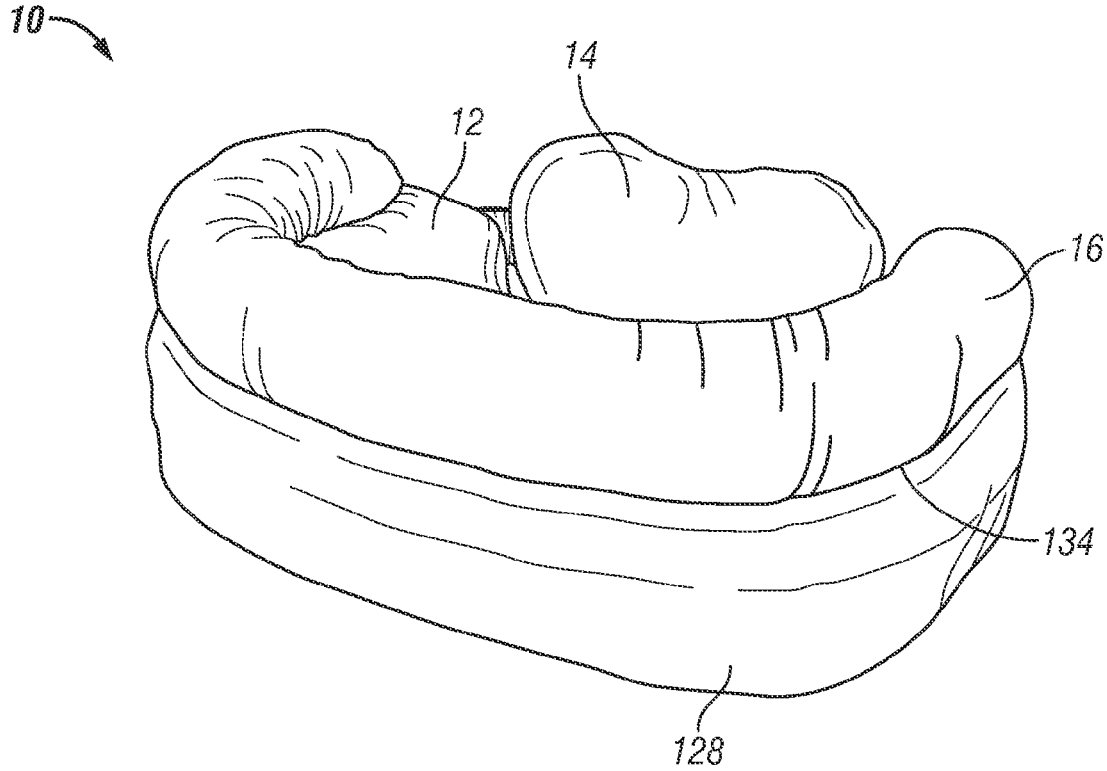
FIG. 2 is a perspective view of the nursing pillow system depicted in FIG. 1.

FIG. 2 is a perspective view of the nursing pillow system depicted in FIG. 1.

Figure 3:
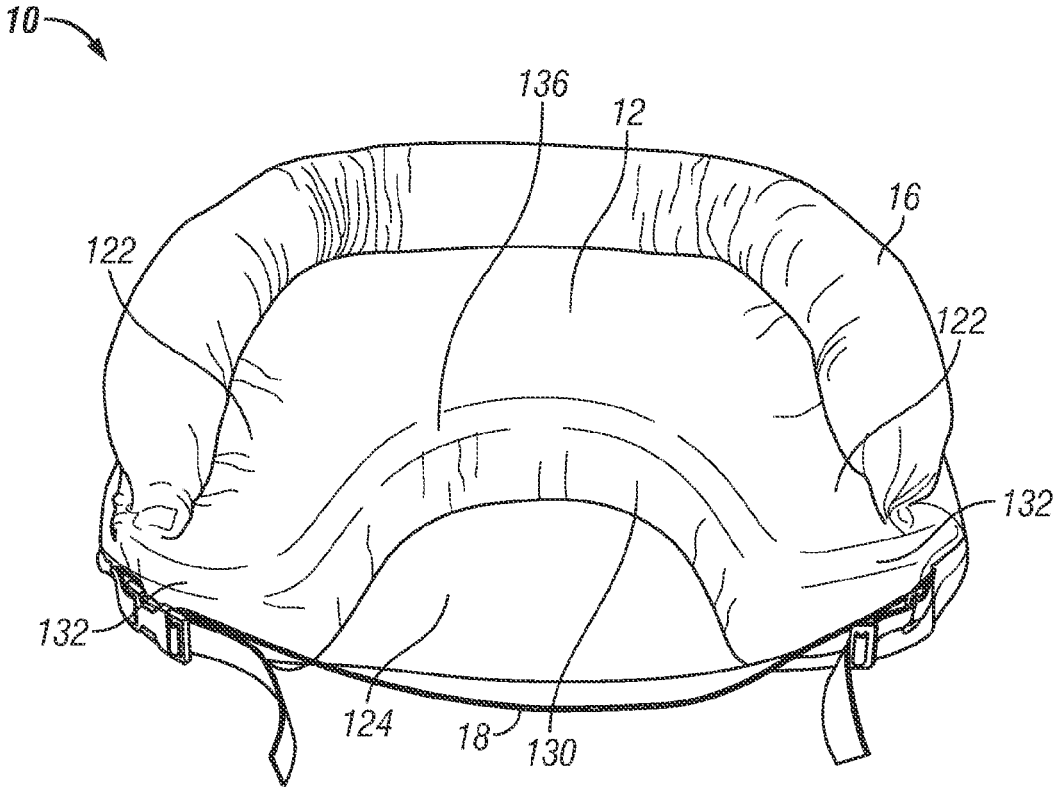
FIG. 3 is a rear perspective view of the nursing pillow system depicted in FIG. 1, showing an attached belt with the back pillow removed.

As shown in FIG. 3, to further increase the closeness of fit between mother and the nursing pillow 12, one embodiment of the nursing pillow system 10 contains an adjustable belt 18 that extends between the arms 122 of the nursing pillow 12, enclosing the area 124 around which the nursing pillow 12 wraps. This belt 18 can be adjusted such that the nursing pillow 12 is securely held against the mother's body, thus preventing movement of the nursing pillow 12 during nursing as well as preventing the child from slipping between the nursing pillow 12 and the mother's body. As shown, the belt 18 can be attached to the nursing pillow 12 by clips or buckles. However, one of skill in the art will recognize that the belt 18 can be attached with any number of attachment means, including stitching, buckles, clips, hook and loop, buttons, or a combination of attachment means, and the like.

Figure 4:
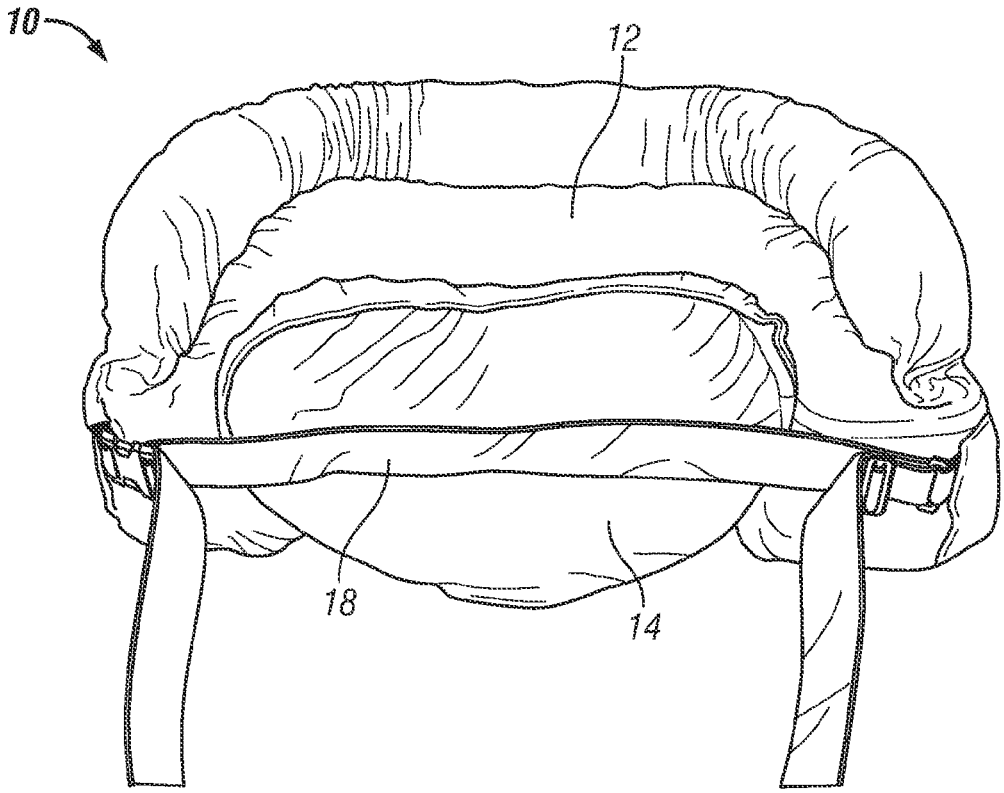
FIG. 4 is the rear perspective view of FIG. 3, shown with the back pillow attached to the belt.
Figure 13:
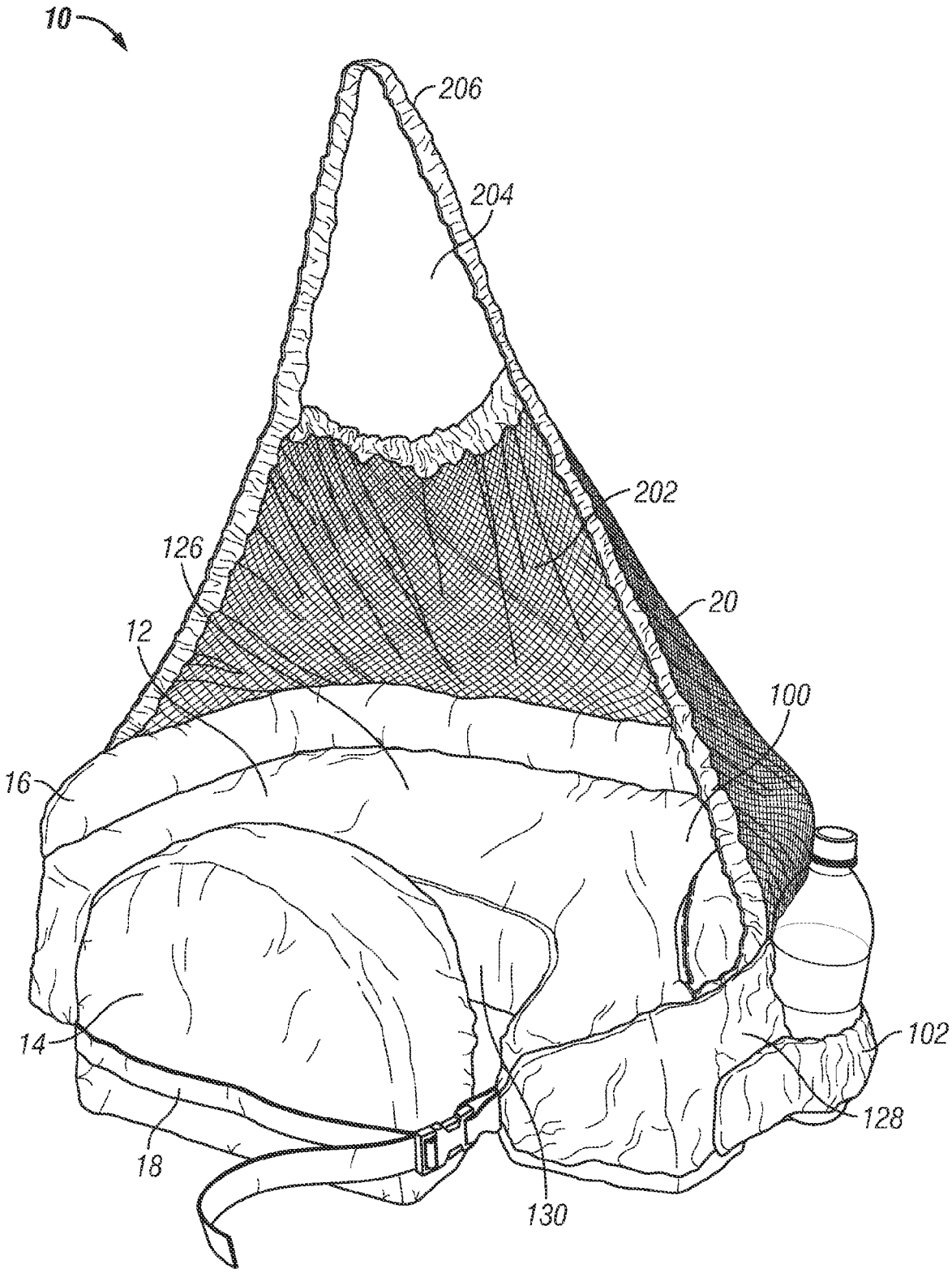
FIG. 13 is a rear perspective view of the nursing pillow system of FIG. 1, showing the cover-up extended.

As shown in FIG. 4, the belt 18 can further retain a back pillow 14 which provides support to the mother's back while wearing the nursing pillow 12 and also increases the comfort of the belt 18. However, in some embodiments, the back pillow 14 and belt 18 are not attached to each other. As depicted in FIG. 13, in another embodiment, the nursing pillow 12 may be configured to removably receive the back pillow 14 along the inside perimeter 130 of the nursing pillow 12 when not in use. In this embodiment, the back pillow 14 and nursing pillow 12 are removably attachable by hook and loop means, but those of skill in the art will recognize that other attachment means are possible, including buttons and zippers.

Figure 5:
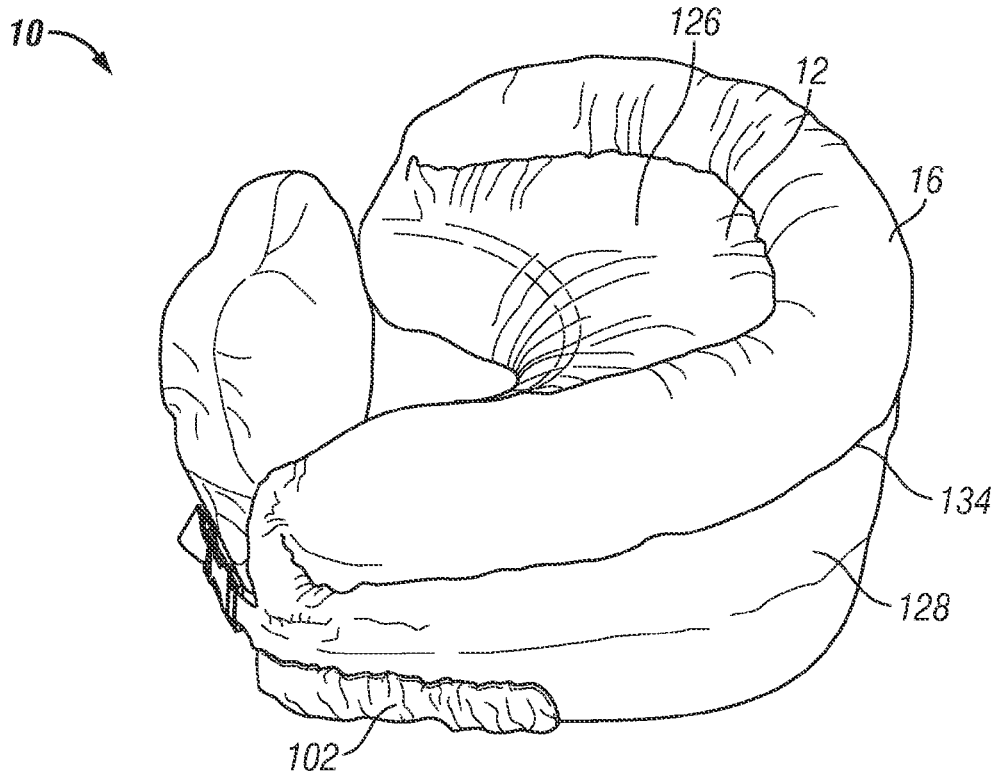
FIG. 5 is a side perspective view of the nursing pillow system depicted in FIG. 1, showing an elastic band attached to the nursing pillow.
Figure 6:
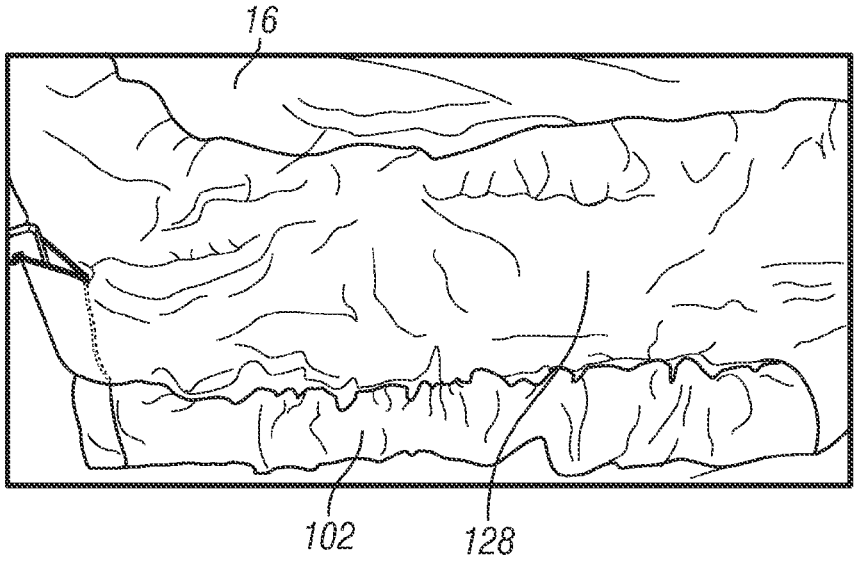
FIG. 6 is a detail view of the elastic band depicted in FIG. 5.

As depicted in FIG. 5, the top surface 126 of the nursing pillow 12 is spaced above the bottom surface (not shown) such that the thickness of the nursing pillow decreases from the outer perimeter 128 of the nursing pillow 12 to the inner perimeter 130 of the nursing pillow 12. In other words, the outer edge 134 of the top surface 126 of the nursing pillow 12 is relatively higher than the inner edge 136 of the top surface 126. This advantageously provides a slope in the top surface 126 of the nursing pillow 12 towards the mother's body, whereby the slope further eases nursing as it supports the child at the proper angle relative the mother and also prevents the child from sliding away from the mother. The alternative nursing pillow 30 embodied in FIG. 14 displays a similarly sloped top surface 326.

As depicted in FIGS. 1-5, embodiments of the nursing pillow system 10 further include a bolster 16 which extends along the outer perimeter 128 of the nursing pillow 12. Preferably, the bolster 16 extends along the outer edge 134 of the top surface 126 of the nursing pillow 12. This bolster 16 enables the mother to further adjust the angle at which the infant rests on the nursing pillow 12 relative to her body by placing parts of the infant on the bolster 16, and also provides an outer boundary to the top surface 126 of the nursing pillow 12 further preventing the child from sliding off the nursing pillow 12 during feeding.

The bolster 16 in the preferred embodiment extends along the outer edge 134 of the top surface 126 of the nursing pillow 12, extending from near the end 132 of one of the arms 122 of the nursing pillow 12 to near the end 132 of the other arm 122 of the nursing pillow 12. Preferably, the bolster 16 extends more than half way down each arm 122 of the pillow 12, more preferably more than three quarters of the way down each arm 122, and most preferable substantially all the way down each arm 122, as depicted in FIGS. 1-5. While the present embodiment of the nursing pillow system 10 illustrates a bolster 16 attached to the nursing pillow 12, one skilled in the art will recognize that the bolster 16 can be incorporated into the nursing pillow system 10 in several ways, including, among others, an integrated bolster 16 and a bolster 16 attached to the nursing pillow cover 100. One skilled in the art will also recognize that a bolster 16 can be attached to the nursing pillow system 10 or nursing pillow 12 using several fastening methods including sewing, hooks and loops, snaps, buttons, zippers, and laces.

Surprisingly, a bolster 16 that runs at least most of the length of the outer edge 134 of the top surface 126 of the nursing pillow 12 provides significantly greater support to the child's body and thus enables the mother to more easily feed the child in a greater variety of positions. By more completely restricting the child's movement and providing more complete support to the child's body, the full-length bolster 16 also enables a mother to more efficiently perform other tasks requiring the use of her hands.

Figure 7:
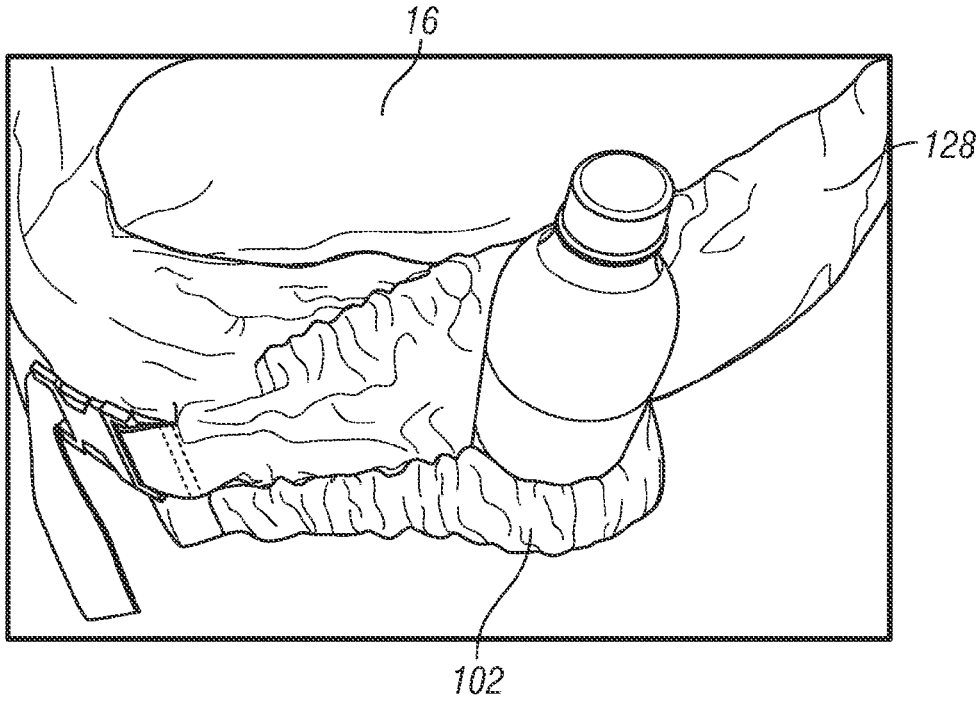
FIG. 7 illustrates a bottle inserted in the elastic band depicted in FIGS. 6 and 7.

In some embodiments, as depicted in FIGS. 5-7 and 13, the comfort of the mother during nursing may be further increased by the attachment of an elastic band 102 to the nursing pillow 12. This band 102 advantageously enables a person to attach a variety of items to the nursing pillow 12 including a water bottle or a baby bottle, as depicted in FIG. 7. This band 102 may be configured such that it attaches to the nursing pillow 12 only at the ends of the band 102, or at a variety of intermediate places throughout the length of the band 102. In some embodiments, this elastic band 102 is attached around the entire outer perimeter 128 of the nursing pillow 12, while in other embodiments this band is only attached to portions of the outer perimeter 128 of the pillow 12. It will be recognized by one skilled in the art that this band may be located in a variety of positions on the nursing pillow system 10 and is not limited to the outer perimeter 128 of the nursing pillow 12 as depicted in the embodiments shown in FIGS. 5-7 and 13. Additionally, the band 102 may be exposed or covered.

Figure 8:
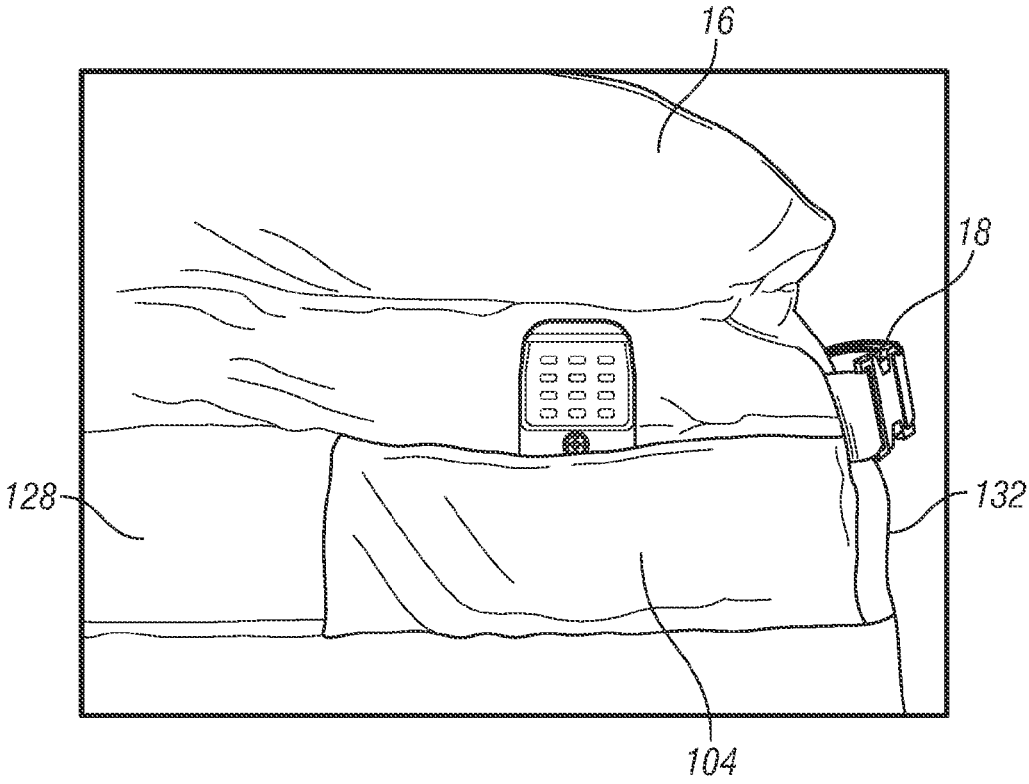
FIG. 8 is a detailed side view of the nursing pillow depicted in FIG. 1, showing a pocket in which a cellular phone is inserted.
Figure 9:
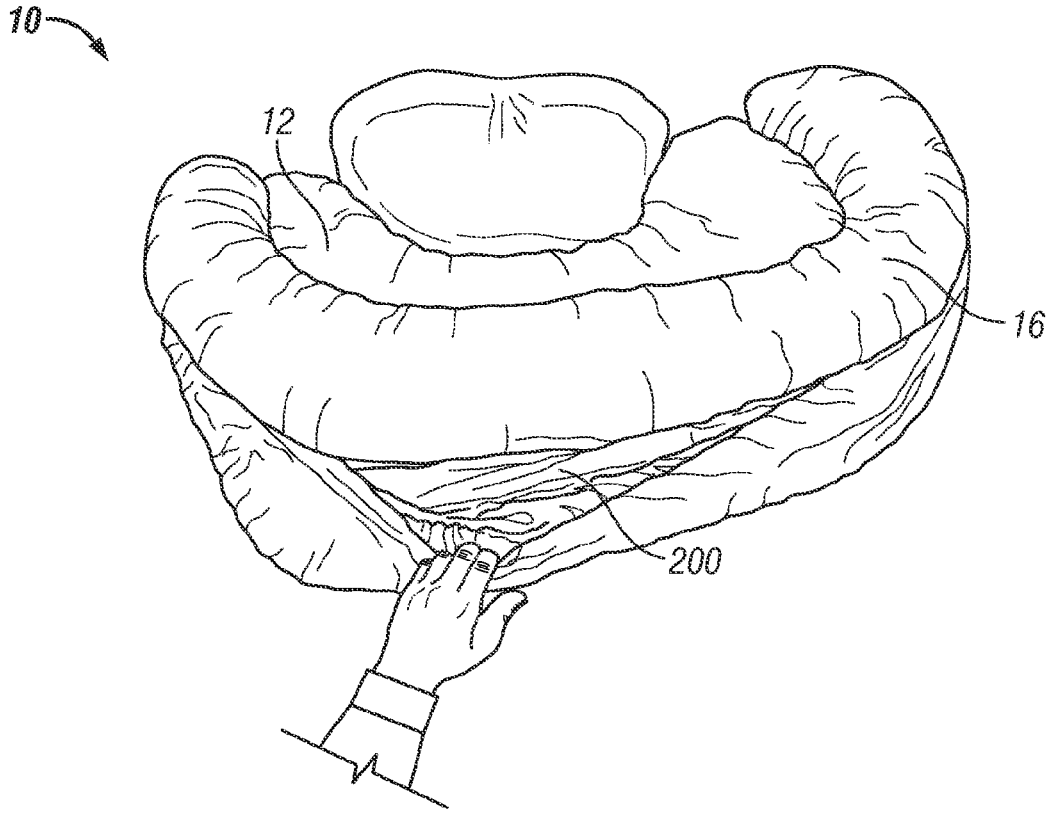
FIG. 9 is a perspective view of the nursing pillow system depicted in FIG. 1, showing another pocket being opened to expose a nursing cover-up therein.
Figure 10:
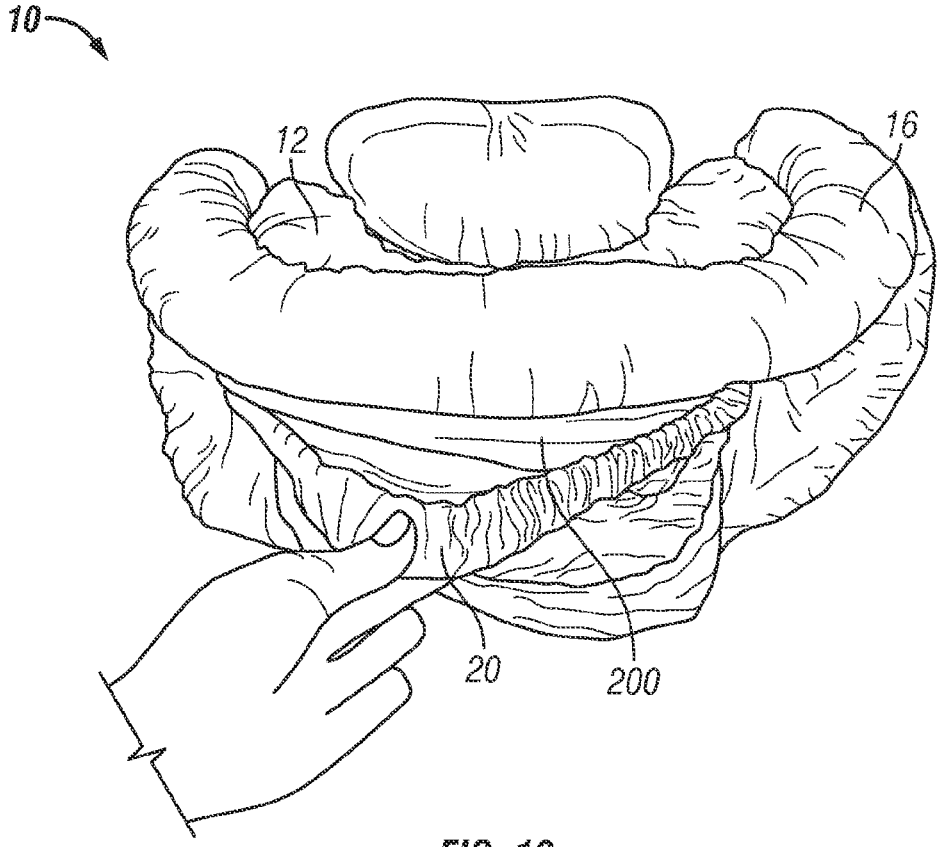
FIG. 10 is the perspective view of FIG. 9, showing the nursing cover-up being pulled from the pocket.
Figure 11:
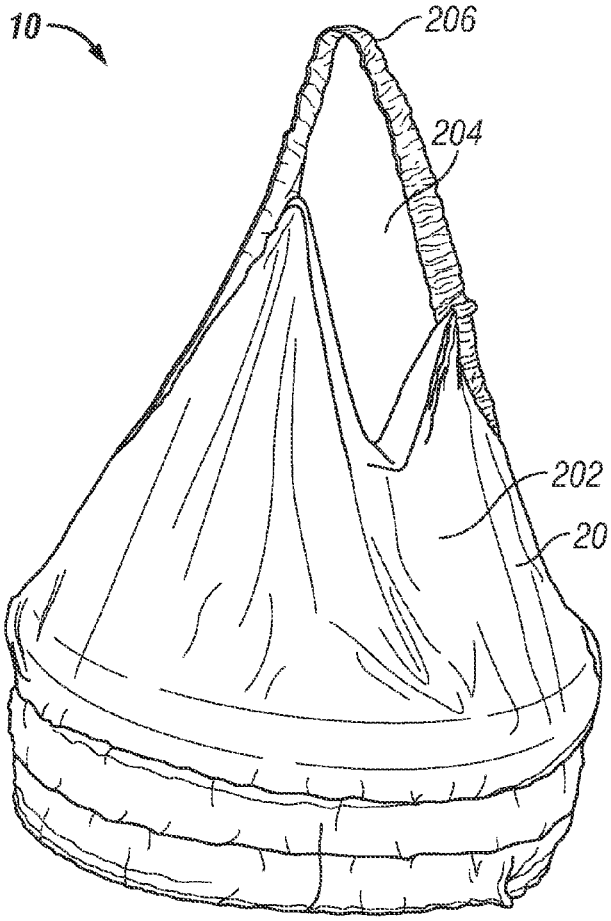
FIG. 11 is the perspective view of FIG. 9, showing the nursing cover-up extended from the pocket.
Figure 12:
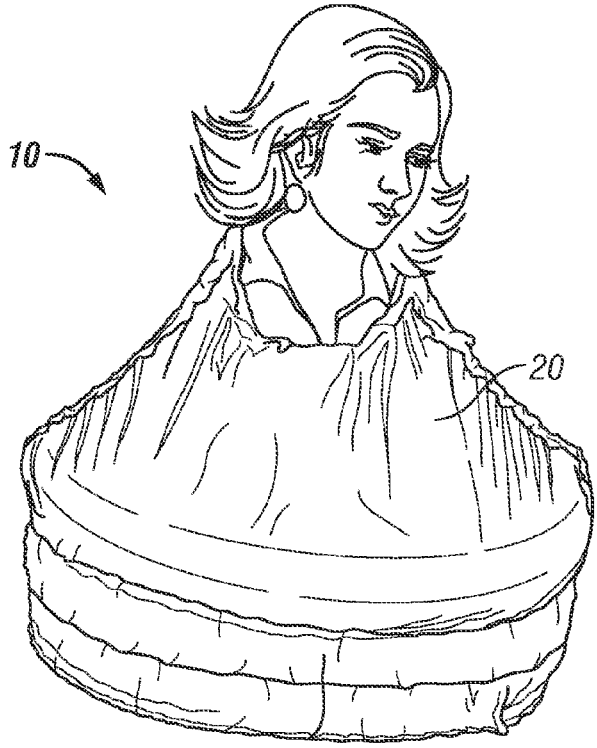
FIG. 12 is a perspective view showing the nursing pillow system of FIG. 1 being used, with the nursing cover-up extended and secured around a user's neck.

As shown in FIG. 8, some embodiments of the nursing pillow system may also include one or several pockets 104. These one or several pockets 104 are designed such that they can hold a variety of items including keys, cell phones, or notepads. These one or several pockets 104 may be located anywhere on the nursing pillow system 10 and may come in a variety of sizes. The pocket 104 depicted in FIG. 8 is located on the outer perimeter 128 of the nursing pillow 12, near the end 132 of one of the arms 122. A cell phone is shown inserted into the pocket 104. It will be recognized by one skilled in the art that this pocket may be located in a variety of positions on the nursing pillow system 10 and is not limited to the outer perimeter 128 of the nursing pillow 12 as depicted in the embodiment shown in FIG. 8.

As shown in FIGS. 9-13, an additional feature of some embodiments of the nursing pillow system 10 is a cover-up 20. This cover-up 20 may be permanently or removably attached to the nursing pillow system 10, nursing pillow 12, or cover 100. One embodiment of the nursing pillow system 10 uses hooks and loops to attach the cover-up 20 to the nursing pillow 12, however, one skilled in the art will recognize that the cover-up 20 may be attached to the nursing pillow system 10 in a variety of ways including by snaps, buttons, or zippers. This cover-up 20, when not in use, may be stored in a pocket 200 located along the bottom of the bolster 16 in the nursing pillow 12. This is especially advantageous because sufficient space exists in this location without affecting the appearance of the pillow 12 when the cover-up 20 is not in use. It will be apparent to one skilled in the art that the cover-up 20 may be stored in a variety of locations and in some embodiments will not be stored on the pillow 12 when not in use.

The cover-up generally comprises a sheet of material 202 that attaches to the outer perimeter 128 of the nursing pillow 12. However, it will be apparent to one skilled in the art that the cover-up may be attached to a variety of locations on the nursing system, including on the bolster 16 or anywhere on any number of removable covers 100. Some embodiments of the cover-up 20 further contain a loop or hole 204 through which may be placed over the mother's head, securing the cover-up 20 such that it surrounds the top surface 126 of the nursing pillow 12, the infant, and the front of the mother's torso. This loop or hole 204 in the cover-up 20 may be created in a variety of ways, including through the use of a detachable belt 206 or an adjustable belt 206 which enables the mother to adjust the size of the loop or hole 204 between the belt 206 and the nursing cover-up 20. This advantageously enables a mother to decrease the size of the hole 204 if she desires more privacy or a darker nursing environment for her child, or alternatively increase the size of the loop or hole 204 if she desires increased light, ventilation, or viewing ability.

The cover-up 20 may be made of a variety of materials. It has been surprisingly discovered that a cover-up 20 comprising materials with ventilation holes, such as a mesh fabric, does not diminish the level of privacy afforded a mother while simultaneously allowing greater ventilation. In light of greater ventilation at minimal cost to privacy, some embodiments of the nursing cover-up 20 may be made of materials containing holes.

Figure 14:
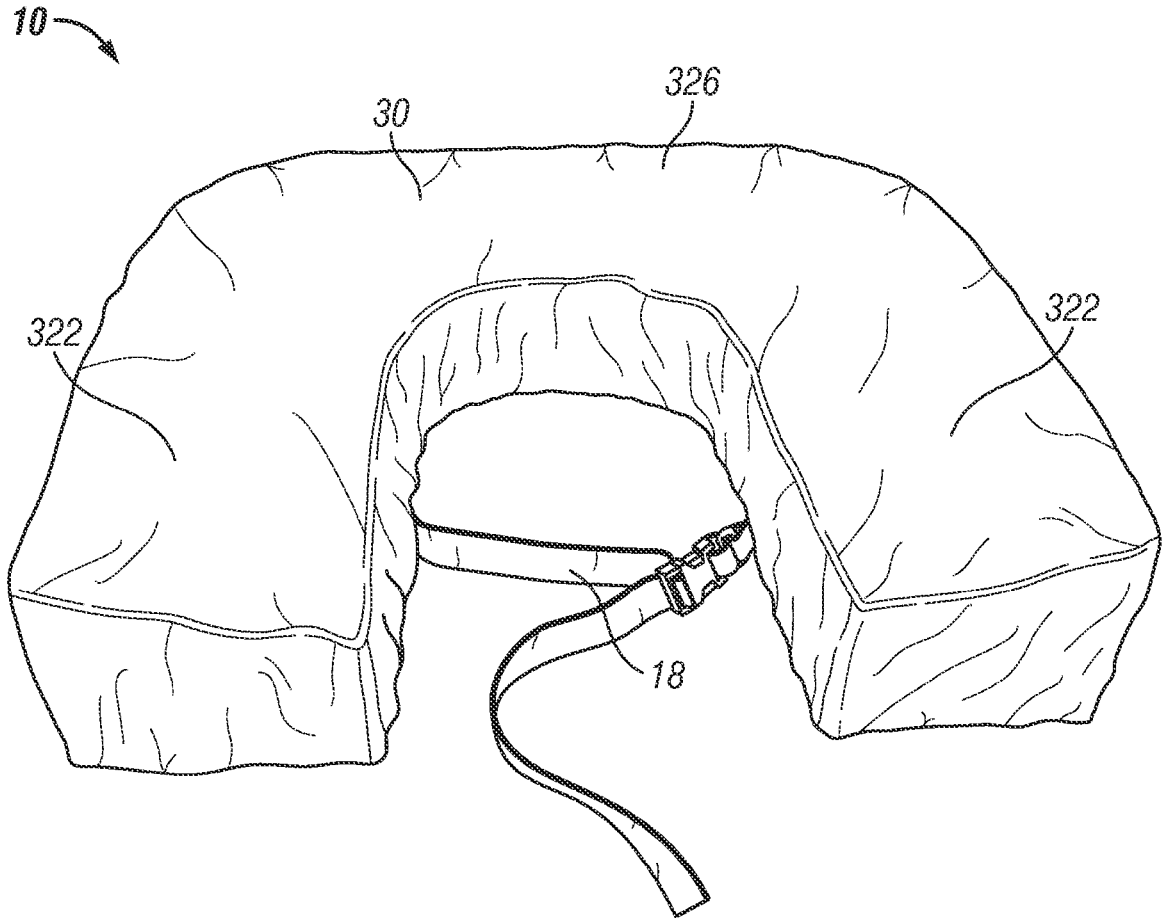
FIG. 14 is a front perspective of another embodiment of the invention, showing an alternative nursing pillow for a nursing pillow system that is designed to accommodate more than one child.

The nursing pillow system 10 may be sized in a variety of ways to fit customer preferences. One embodiment may comprise a single baby pillow and another embodiment may comprise a twin baby pillow 30, depicted in FIG. 14. A twin baby pillow 30 is generally similar to the single baby pillow but with different dimensions. In a preferred embodiment, a single baby nursing pillow has the following dimensions: 22" long, 9" deep, 3.5" thick at the inner perimeter, 5.5" thick at the outer perimeter, 11" wide opening for the user, and 5" wide arms. Generally, the pillow designed for twins 30 is a little wider and has longer arms 322 so that the babies' legs can each extend down one of the respective arms 322 during feeding. For example, in a preferred embodiment, a twin baby pillow has the following dimensions: 24" across, 21" deep, 4" thick at the inner perimeter, 6" thick at the outer perimeter, 10" opening for the user, and 7" wide arms. For purposes of this invention, the term "twin" is defined as more than one child, and is not limited to children that are related, by blood or otherwise. As shown in FIG. 14, some embodiments of the twin baby pillow 30 do not include a bolster. In other embodiments, a bolster may be attached to the twin baby pillow 30. It will be recognized by one skilled in the art that the present invention is not limited to the enumerated dimensions of these embodiments but may come in any size and can be used with infants placed in a variety of positions on the pillow.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A nursing pillow system, comprising:

a nursing pillow, defining an outer perimeter opposite a user, and comprising a bolster extending along said outer perimeter, wherein the bolster comprises a pocket extending along a majority of a length of a bottom of the bolster at a front of the nursing pillow, a cover-up permanently or removably attached to the front of the nursing pillow, wherein the cover-up is configured to cover at least a portion of a user and a baby when in use, and wherein the pocket is configured to store all of the attached cover-up when not in use.

2. The nursing pillow system of claim 1, wherein the cover-up is removably attached to the nursing pillow.

3. The nursing pillow system of claim 1, wherein the cover-up comprises a loop or hole which is configured to be placed over the user's head.

4. The nursing pillow system of claim 1, wherein the cover up comprises a mesh fabric.

5. The nursing pillow system of claim 1 further comprising a back pillow.

6. The nursing pillow system of claim 1, wherein the bolster extends substantially all the way down each arm along said outer perimeter.

7. The nursing pillow system of claim 6, wherein the bolster is formed integrally with the nursing pillow.

8. The nursing pillow system of claim 1, wherein the nursing pillow further defines an overall length and overall depth, and the arms define a width, wherein:

the overall length is approximately 21 inches, the overall depth is approximately 9 inches, the thickness at the inner perimeter is approximately 3.5 inches, the thickness at the outer perimeter is approximately 5.5 inches, and the width of the arms is approximately 5 inches.

9. The nursing pillow system of claim 1, wherein the nursing pillow further defines an overall length and overall depth, and the arms define a width, wherein:

the overall length is approximately 24 inches, the overall depth is approximately 21 inches, the thickness at the inner perimeter is approximately 4 inches, the thickness at the outer perimeter is approximately 6 inches, and the width of the arms is approximately 7 inches.

10. A nursing pillow system, comprising:

a nursing pillow comprising a generally U-shape form defining a thickness, inner perimeter, outer perimeter, and two arms, wherein the thickness decreases from said outer perimeter to said inner perimeter, a pillow cover attached to said nursing pillow, a belt attached to said pillow cover, a back pillow, a bolster extending at least halfway down each arm along said outer perimeter, wherein the bolster is attached to said pillow cover, a cover-up removably or permanently attached to said pillow cover, wherein the cover-up is comprised of mesh fabric, and a pocket extending along a majority of a length of the bottom of the bolster at the front of the nursing pillow, wherein the pocket is configured to store all of the attached cover-up.

11. The nursing pillow system of claim 10, wherein the nursing pillow is configured to removably receive the back pillow along the inner perimeter of the nursing pillow.

* * * * *